US007456679B2

(12) United States Patent
Pigott et al.

(10) Patent No.: US 7,456,679 B2
(45) Date of Patent: Nov. 25, 2008

(54) REFERENCE CIRCUIT AND METHOD FOR GENERATING A REFERENCE SIGNAL FROM A REFERENCE CIRCUIT

(75) Inventors: John M. Pigott, Phoenix, AZ (US); Byron G. Bynum, Gilbert, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 50 days.

(21) Appl. No.: 11/416,273

(22) Filed: May 2, 2006

(65) Prior Publication Data

US 2007/0257729 A1 Nov. 8, 2007

(51) Int. Cl.
*G05F 1/10* (2006.01)
*G05F 3/02* (2006.01)

(52) U.S. Cl. ..... 327/539; 327/542; 323/313

(58) Field of Classification Search ..... 327/530, 327/538–543, 545, 546; 323/313, 315, 317
See application file for complete search history.

(56) References Cited

U.S. PATENT DOCUMENTS 5,619,163 A * 4/1997 Koo ..... 327/539
5,926,062 A * 7/1999 Kuroda ..... 327/538
5,966,039 A * 10/1999 Koglin et al. ..... 327/356
6,407,622 B1 * 6/2002 Opris ..... 327/539
6,489,835 B1 * 12/2002 Yu et al. ..... 327/539
6,529,066 B1 * 3/2003 Guenot et al. ..... 327/539
6,642,778 B2 * 11/2003 Opris ..... 327/539
6,710,641 B1 * 3/2004 Yu et al. ..... 327/539
6,885,178 B2 * 4/2005 Marinca ..... 323/316
6,989,708 B2 * 1/2006 Xi ..... 327/539
6,995,587 B2 * 2/2006 Xi ..... 327/77
7,053,694 B2 * 5/2006 Ozawa ..... 327/539
7,071,767 B2 * 7/2006 Ou-yang et al. ..... 327/539
7,075,282 B2 * 7/2006 Feng ..... 323/313
7,253,597 B2 * 8/2007 Brokaw ..... 323/314
7,259,543 B2 * 8/2007 Chih ..... 323/316

(Continued)

OTHER PUBLICATIONS

IEEE Journal of Solid-State Circuits, vol. 37, No. 4, Apr. 2002—A Sub-1-V 15-ppm° C. CMOS Bandgap Voltage Reference Without Requiring Low Threshold Voltage Device; Ka Nang Leung, *Student Member, IEEE*, and Philip K. T. Mok, *Senior Member, IEEE*.

(Continued)

*Primary Examiner*—Lincoln Donovan
*Assistant Examiner*—Patrick O'Neill
(74) *Attorney, Agent, or Firm*—Bryan Cave LLP

(57) ABSTRACT

A reference circuit includes: (a) a first reference circuit having a reference signal and a $\Delta V_{BE}$ loop; and (b) a modification circuit using a first voltage to change a first current in the $\Delta V_{BE}$ loop of the first reference circuit. In one embodiment, the reference circuit is a voltage reference circuit. In some embodiments, the reference circuit can include a bandgap core circuit, which adds a $V_{BE}$ and a multiplied $\Delta V_{BE}$, so that the output voltage of the reference circuit is a bandgap voltage. The reference circuit also can also include a modification circuit, which uses the output voltage (i.e. the reference signal) of the bandgap core circuit to change a current in the $\Delta V_{BE}$ loop. The $\Delta V_{BE}$ loop can be the portion of the circuit involved in generating the $\Delta V_{BE}$ voltage. Other embodiments are disclosed in this application.

25 Claims, 6 Drawing Sheets

U.S. PATENT DOCUMENTS

| | | | | |
|---|---|---|---|---|
| 7,274,250 | B2 * | 9/2007 | Hazucha et al. | 327/539 |
| 2005/0035812 | A1 * | 2/2005 | Xi | 327/539 |
| 2005/0035813 | A1 * | 2/2005 | Xi | 327/539 |
| 2006/0043957 | A1 * | 3/2006 | Carvalho | 323/313 |
| 2007/0164809 | A1 * | 7/2007 | Fukuda et al. | 327/539 |

OTHER PUBLICATIONS

IEEE Journal of Solid-State Circuits, vol. 34, No. 5, May 1999—A CMOS Bandgap Reference Circuit with Sub-1-V Operation; Hironori Banba, Hitoshi Shiga, Akira Umezawa, Takeshi Miyaba, Toru Tanzawa, Shigeru Atsumi, and Koji Sakui, *Member, IEEE*.

IEEE Journal of Solid-State Circuits, vol. 28, No. 6, Jun. 1993—A Curvature-Corrected Low-Voltage Bandgap Reference; Made Gunawan, Gerard C.M. Meijer, Jeroen Fonderie, and Johan H. Huijsing, *Senior Member, IEEE*.

IEEE Journal of Solid-State Circuits, vol. 36, No. 7, Jul. 2001—Curvature-Compensated BiCMOS Bandgap with 1-V Supply Voltage; Piero Malcovati, Franco Maloberti, *Fellow, IEEE*, Carlo Fiocchi, and Marcello Pruzzi.

IEEE Journal Of Solid-State Circuits, vol. SC-9, No. 6, Dec. 1974—A Simple Three-Terminal IC Bandgap Reference, A. Paul Brokaw, Member IEEE.

* cited by examiner

900

1000

REFERENCE CIRCUIT AND METHOD FOR GENERATING A REFERENCE SIGNAL FROM A REFERENCE CIRCUIT

FIELD OF THE INVENTION

This invention relates generally to electrical circuits, and relates more particularly to reference circuits.

BACKGROUND OF THE INVENTION

The requirement for a stable reference voltage is almost universal in electronic design. Circuits that provide a stable reference voltage are used in dynamic random access memories (DRAMs), flash memories, analog devices, and other applications. These circuits require voltage generators that are stable over manufacturing process variations, supply voltage variations, and operating temperature variations and can be implemented without modifications of conventional manufacturing processes. Low voltage, battery operated circuits, operating at voltages as low as 0.9 volts (V), are becoming more common and also require stable, precise temperature-independent reference voltages.

The most common conventional reference circuit for low voltage applications is a bandgap reference circuit. The basic concept behind a bandgap reference circuit is to add a voltage with a positive temperature coefficient to a voltage with a negative temperature coefficient. When the two voltages are summed, the temperature coefficients cancel out each other, and the combined voltage source will be temperature independent.

Conventional silicon bandgap circuits suffer from an intrinsic limitation of having a minimum output voltage of approximately 1.25 V, i.e., the voltage of the bandgap of silicon. Today, this voltage acts as the lower limit on reference voltages for most applications.

There have been many attempts to overcome this 1.25 V limitation and create a sub-1.25 V reference circuit. However, conventional sub-1.25 V reference circuits suffer from a combination of high impedance outputs, increased current consumption, and a non-zero temperature coefficient in the sub-1.25 V region. Finally, most of these reference circuits are quite complex.

Accordingly, a need exists for a simple reference circuit, which can operate in the sub-1.25 V region while retaining substantial independence from temperature and process variations.

BRIEF DESCRIPTION OF THE DRAWINGS

The invention will be better understood from a reading of the following detailed description, taken in conjunction with the accompanying figures in the drawings in which.

Figure 1:
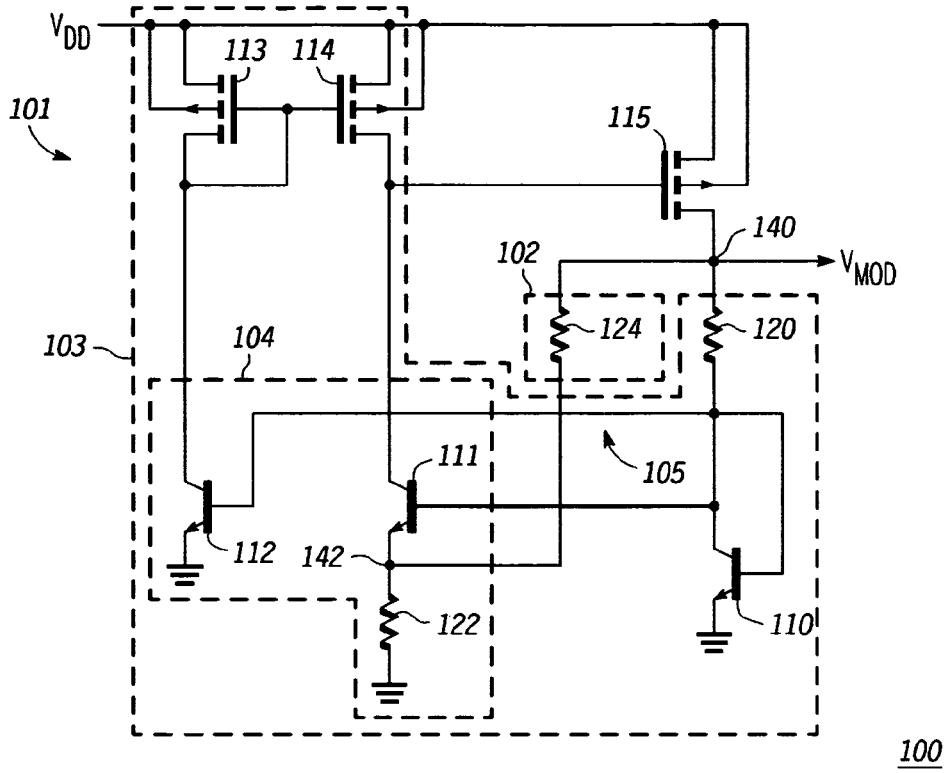
FIG. 1 illustrates a first reference circuit according to a first embodiment of the present invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus. The term "coupled," as used herein, is defined as directly or indirectly connected in an electrical or non-electrical manner.

DETAILED DESCRIPTION OF THE INVENTION

In an embodiment of the invention, a reference circuit includes: (a) a first reference circuit having a reference signal and a $\Delta V_{BE}$ loop; and (b) a modification circuit using a first voltage to change a first current in the $\Delta V_{BE}$ loop of the first reference circuit. In another embodiment of the invention, a reference signal is generated using the following steps: (a) using a first reference circuit to generate a reference signal, wherein the reference circuit has a $\Delta V_{BE}$ loop; and (b) using a modification circuit electrically to the $\Delta V_{BE}$ loop of the first reference circuit to change a first current in the $\Delta V_{BE}$ loop of the first reference circuit.

As a more detailed description of an embodiment of the invention, a reference circuit includes a bandgap core circuit, which adds a $V_{BE}$ and a multiplied $\Delta V_{BE}$, so that the output voltage of the reference circuit is a bandgap voltage. The multiplied $\Delta V_{BE}$ is generally derived by passing a $\Delta V_{BE}$ current (itself derived from a $\Delta V_{BE}$ voltage across a resistor) through another resistor. The $\Delta V_{BE}$ voltage is derived from the difference between forward junction voltages ($V_{BE}$'s) from two transistors operated at different current densities (e.g. from the same current in different sized transistors, or different currents in the same-sized transistors, or a combination of the two). The reference circuit also includes a modification circuit, which uses the output voltage (i.e. reference signal) of the bandgap core circuit to change a current in the $\Delta V_{BE}$ loop. The $\Delta V_{BE}$ loop is the portion of the circuit involved in generating the $\Delta V_{BE}$ voltage.

A bandgap-based reference circuit that is manufactured in silicon generates a substantially constant reference voltage, approximately equal to the bandgap voltage of silicon, by adding a voltage across a forward-biased p-n junction in the circuit, to a PTAT (Proportional To Absolute Temperature) voltage. This PTAT voltage is a multiple of a $\Delta V_{BE}$ voltage which is generated by running different current densities through similar p-n junctions or base-to-emitter junctions. The different current densities can be generated by running the same current in different sized transistors, or different currents in the same-sized transistors, or a combination of the two. Typically, the PTAT voltage is generated by using a ratio of the resistances of two resistors. In bandgap reference circuits, the output voltage (which is substantially independent of temperature) is created by combining a voltage, which has a negative temperature dependence (generated across a p-n junction) with a voltage which has a positive temperature dependence (the PTAT voltage).

FIG. 1 illustrates a first embodiment of a bandgap reference circuit 100 according to an embodiment of the present invention. It should be understood that this reference circuit 100 is merely exemplary and that the present invention may be employed in many different structures and circuits not specifically depicted herein.

As an example, reference circuit 100 can comprise a conventional Widlar bandgap circuit 101 and a modification circuit 102 coupled to circuit 101. Circuit 101 can comprise bipolar transistors 110, 111, and 112, MOSFET (metal-oxide semiconductor field-effect transistor) transistors 113, 114, and 115, and resistors 120, and 122. Transistors 113, and 114 form a current mirror and provide substantially equal currents to the collectors of bipolar transistors 111 and 112. Generally, a bandgap core circuit is a circuit which adds a $V_{BE}$ voltage and a multiple of a $\Delta V_{BE}$ voltage such that the output voltage is a bandgap voltage. In this example, the bandgap core circuit 103 includes transistors 110, 111, 112, 113, and 114 along with resistors 120 and 122.

Generally, a $\Delta V_{BE}$ loop is the portion of circuit 103 involved in generating the $\Delta V_{BE}$ voltage. In this example, a $\Delta V_{BE}$ loop 104 comprises transistors 111 and 112 and resistor 122. Transistor 115 acts as an output transistor for circuit 100 to regulate the output current of circuit 100 at a node 140. Transistors 110 and 111 are preferably matched, but are operated at different current densities to produce temperature proportional voltages across resistor 122. Transistor 112 is used to sense or drive the output voltage through resistor 120.

Circuit 100 includes a feedback loop 105 driven by transistor 115, which drives the bases of transistors 111 and 112 such that transistors 111 and 112 carry substantially equal currents. A $\Delta V_{BE}$ voltage is generated between the emitters of transistors 111 and 112. Resistor 120 and transistor 110 cause the output voltage developed at node 140 to be equal to the forward voltage of transistor 110 and an additional voltage equal to the current of transistor 110 times the resistance of resistor 120.

Circuit 102 supplies a portion of the current required by resistor 122 and, thus, decreases the current required in transistors 111 and 112 to keep $\Delta V_{BE}$ loop 104 in regulation. As an example, circuit 102 can comprise a resistor 124 electrically coupled to the output at node 140 and to $\Delta V_{BE}$ loop 104 at a node 142. If circuit 102 were removed from circuit 100, the output voltage or reference signal of circuit 100 at node 140 is:

$$V_{Bandgap} = V_{BE} + \Delta V_{BE} \cdot \frac{R_{120}}{R_{122}}$$

where $V_{Bandgap}$ is the output voltage at node 140, $V_{BE}$ is the forward voltage of the base-to-emitter junction of transistor 112, $R_{122}$ is the resistance of resistor 122, $R_{120}$ is the resistance of resistor 120, and $\Delta V_{BE}$ is the voltage drop across resistor 122.

When circuit 102 is present in circuit 100, the current through transistor 111, $I_{111}$, is:

$$I_{111} = \frac{\Delta V_{BE}}{R_{122}} - \frac{V_{mod}}{R_{124}}$$

where $V_{mod}$ is the output voltage at node 140, $R_{122}$ is the resistance of resistor 122, and $R_{124}$ is the resistance of resistor 124. Thus, the new or modified output voltage or reference voltage, $V_{mod}$, at node 140 is:

$$\begin{aligned} V_{mod} &= V_{BE} + I_{111} \cdot R_{120} \\ &= V_{BE} + \left(\frac{\Delta V_{BE}}{R_{122}} - \frac{V_{mod}}{R_{124}}\right) \cdot R_{120} \\ &= V_{BE} + \frac{\Delta V_{BE}}{R_{122}} \cdot R_{120} - \frac{V_{mod}}{R_{124}} \cdot R_{120} \\ &\cong V_{Bandgap} - \frac{V_{mod}}{R_{124}} \cdot R_{120} \\ &\cong \frac{V_{Bandgap}}{1 + \frac{R_{120}}{R_{124}}} \end{aligned}$$

where $V_{Bandgap}$ is the output voltage described previously, and $R_{124}$ is the resistance of resistor 124.

Thus, by choosing a suitable ratio of the resistance values of resistors 120 and 124, a reference voltage lower than the bandgap voltage of silicon can be created at the output of circuit 100 when circuit 100 is built in silicon. Circuit 100 is not limited to use in circuits formed on silicon. Instead, circuit 100 can be used to modify the bandgap voltage of circuits built in any type of semiconductor material. As another example, circuit 100 can provide a reference voltage lower than the bandgap voltage of gallium arsenide (GaAs) when circuit 100 is built in a GaAs material.

Figure 2:
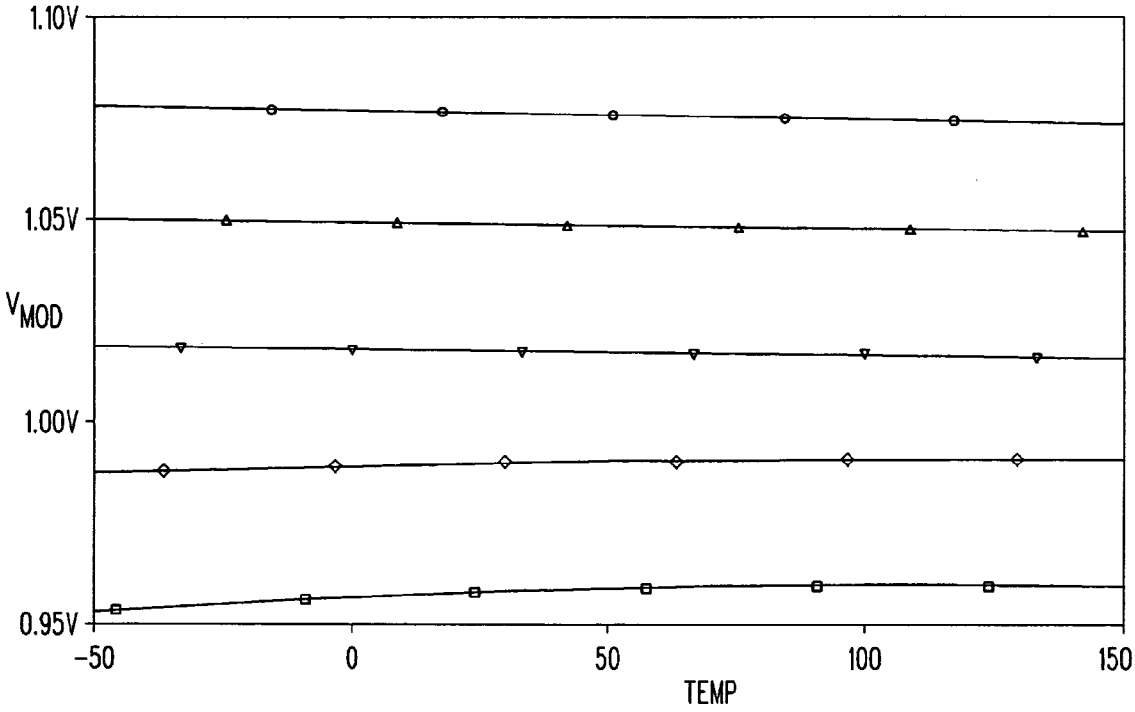
FIG. 2 is a graph showing a relationship between voltage and temperature for different ratios of resistance values in the circuit of FIG. 1.

When correctly designed, the output voltage, $V_{mod}$, of circuit 100 is substantially independent of temperature and the input voltage to circuit 103. FIG. 2 shows the results of a computer simulation of the effects of temperature on the output voltage, $V_{mod}$, at node 140 of circuit 100 in FIG. 1. Each voltage line in FIG. 2 represents a different ratio of resistance values of resistors 120 and 124 in FIG. 1. The sub-1.25 V output voltages, as shown in FIG. 2, are stable and substantially independent of temperature.

A start-up circuit may be necessary for proper functioning of circuit 100 of the present embodiment. For example, a start-up circuit can raise the output voltage, $V_{mod}$, until current begins to flow in transistors 110, 111, and 112. Start-up circuits are well-known in the art, and a conventional start-up circuit can be used to prevent many undesirable consequences.

In another embodiment, circuit 100 can be used as a current reference circuit. Loop 104 generates a constant current of $$\frac{\Delta V_{BE}}{R_{122}}$$

across resistor 122. The current can be used as an output current to transform circuit 100 into a current reference circuit.

The equations above can be expressed more generally, e.g., a substantially fixed current is subtracted from the $\Delta V_{BE}$ current of a conventional bandgap circuit to create a new or modified reference voltage. Generally, the modification circuit will change the current in the transistors in the $\Delta V_{BE}$ loop, but may or may not change the current in the resistors of the $\Delta V_{BE}$ loop. However, the current in the transistors will change, and the output voltage is $V_{BE}$ plus the $\Delta V_{BE}$ current times a constant factor.

The new reference voltage of an embodiment of the present invention may be smaller than the reference voltage of the conventional bandgap circuit. That is, the reference circuit in an embodiment of the present invention can create a sub-1.25 V reference circuit. The new reference voltage is generated by coupling a modification circuit to the reference voltage and the $\Delta V_{BE}$ loop. Specifically, the new reference voltage (or reference signal), $V_{mod}$, is equal to:

$$\begin{aligned} V_{mod} &= V_{BE} + (\Delta V_{BE} - \alpha \cdot V_{mod}) \cdot \frac{R_2}{R_1} \\ &= V_{BE} + \Delta V_{BE} \cdot \frac{R_1}{R_2} - a \cdot V_{mod} \cdot \frac{R_2}{R_1} \\ &\cong V_{Bandgap} - \alpha \cdot V_{mod} \cdot \frac{R_2}{R_1} \end{aligned}$$

$$V_{Bandgap} \cong V_{mod}\left(1 + \alpha \cdot \frac{R_2}{R_1}\right)$$

$$\begin{aligned} V_{mod} &\cong \frac{V_{Bandgap}}{\left(1 + \alpha \cdot \frac{R_2}{R_1}\right)} \\ &\cong \frac{V_{Bandgap}}{\left(1 + \frac{R_2}{R_3}\right)} \end{aligned}$$

where $V_{BE}$ is the forward voltage of base-to-emitter junction of a transistor in the bandgap circuit, $\Delta V_{BE}$ is the voltage drop across resistor $R_1$, $R_1$ is the resistance value of a resistor in a bandgap core circuit, $R_2$ is the resistance value of a resistor in a modification circuit, $R_3$ is the resistance value of another resistor in the bandgap core circuit, and $\alpha$ is $$\frac{R_1}{R_3}.$$

As explained hereinafter, there is a small approximation error in this equation because the $V_{BE}$ of the bandgap circuit with the modification circuit is not quite identical to the $V_{BE}$ in the conventional bandgap circuit. However, this approximation does not significantly affect the output voltage or temperature coefficient.

The reference circuit in an embodiment of the present invention does not require the use of an intermediate voltage level equal to a bandgap voltage. The circuit also supports simple manufacturing by allowing easy trimming of one of the bandgap resistors (e.g., resistor 122 in FIG. 1). The modification to the $\Delta V_{BE}$ current can be generated in the base or emitter connections of the $\Delta V_{BE}$ loop. Typically, the most suitable connection to generate the modification to the $\Delta V_{BE}$ current is the one which will be approximately a bandgap-voltage difference from the node where the modification circuit will be coupled.

Figure 3:
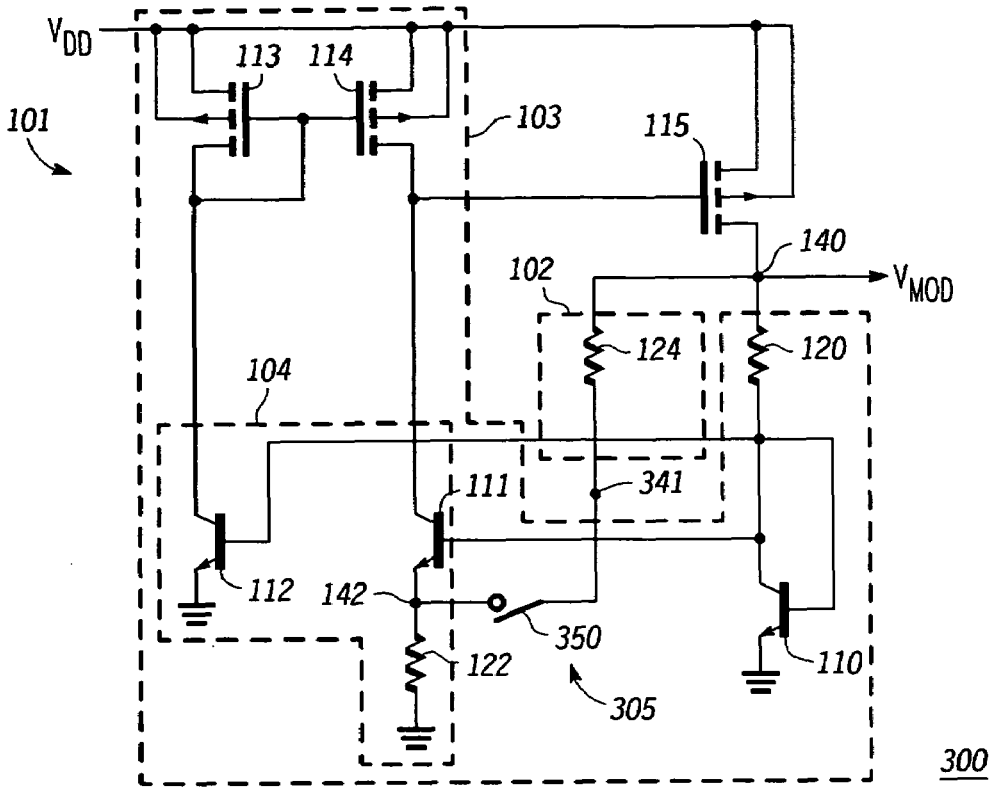
FIG. 3 illustrates a second reference circuit according to a second embodiment of the present invention.

FIG. 3 illustrates a reference circuit 300 according to a second embodiment of the present invention. In this embodiment, circuit 300 can be similar for circuit 100 of FIG. 1, except that circuit 300 also includes a disconnection circuit 305. Disconnection circuit 305 allows the electrically disconnection of modification circuit 102 from bandgap core circuit 103.

As an example, in FIG. 3, circuit 305 comprises a switch 350. Switch 350 is electrically coupled in series with modification circuit 102 at a node 341 and coupled to circuit 103 at node 142. Circuit 102 can comprise a resistor 124 electrically coupled to the output at node 140 and circuit 305 at node 341. Switch 350 allows circuit 102 to be electrically disconnected from circuit 300. When circuit 302 is disconnected, resistor 122 can be trimmed.

Figure 4:
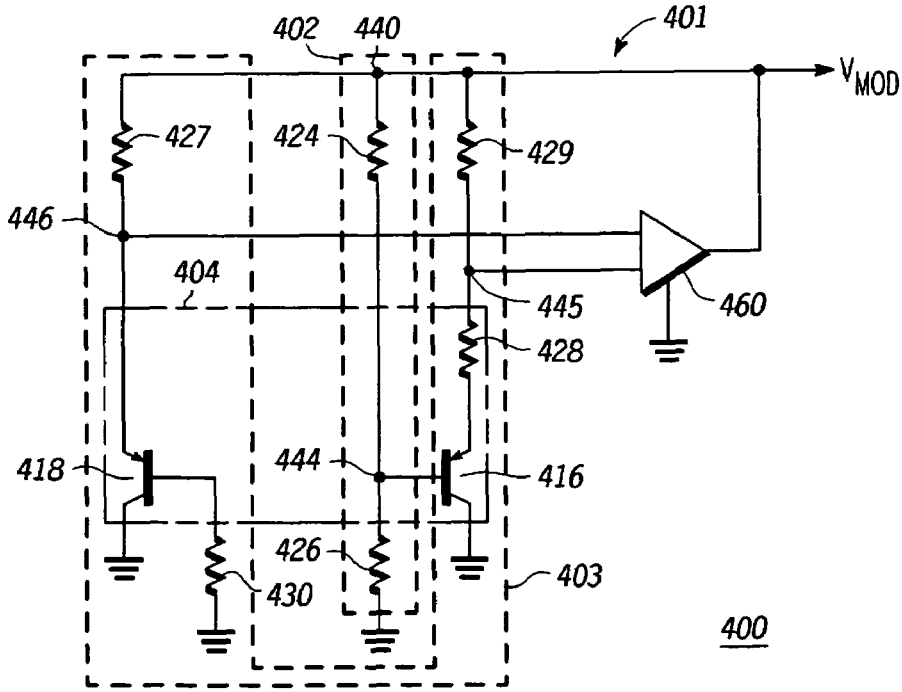
FIG. 4 illustrates a third reference circuit according to a third embodiment of the present invention.

FIG. 4 illustrates a reference circuit 400 according to a third embodiment of the present invention. As an example, reference circuit 400 can comprise a bandgap circuit 401 with an additional resistor 430, and a modification circuit 402 electrically coupled to circuit 401.

In one embodiment, circuit 401 comprises a bandgap core circuit 403 and an operational amplifier 460. Circuit 403 comprises two bipolar NPN transistors 416 and 418, and resistors 427, 428, 429, and 430. A $\Delta V_{BE}$ loop 404 of circuit 403 comprises transistors 416 and 418 and resistor 428. Circuit 402 comprises resistors 424 and 426. The collector regions of transistors 416 and 418 are coupled directly to ground, and the bases of transistors 416 and 418 are coupled to ground through resistors 426 and 430, respectively. An emitter of transistor 418 is electrically coupled at a node 446 to an input of amplifier 460 and to resistor 427. A resistor 428 is coupled to an emitter of transistor 416 and to a node 445, which is coupled to another input of amplifier 460 and to resistor 429.

Similarly to previous embodiments of the present invention, when circuit 402 is present in circuit 400, the modified output reference voltage at node 440, $V_{mod}$, is:

$$V_{mod} \cong \frac{V_{BG}}{1 + \frac{R_{428}}{R_{424}}}$$

where $V_{BG}$ is output voltage of circuit 400 without circuit 402, $R_{428}$ is the resistance of resistor 428, and $R_{424}$ is the resistance of resistor 424. The output voltage of circuit 400, $V_{mod}$, is substantially independent of temperature and the input voltage to circuit 403.

Unlike the first embodiment of the invention, shown in FIG. 1, circuit 402 subtracts a substantially fixed voltage from the voltage in loop 404 to change the current in transistors 418 and 416, and resistor 426.

A start-up circuit may be necessary for proper functioning of circuit 400 of the present embodiment. Start-up circuits are well-known in the art, and a conventional start-up circuit can be used to prevent many undesirable consequences.

Figure 5:
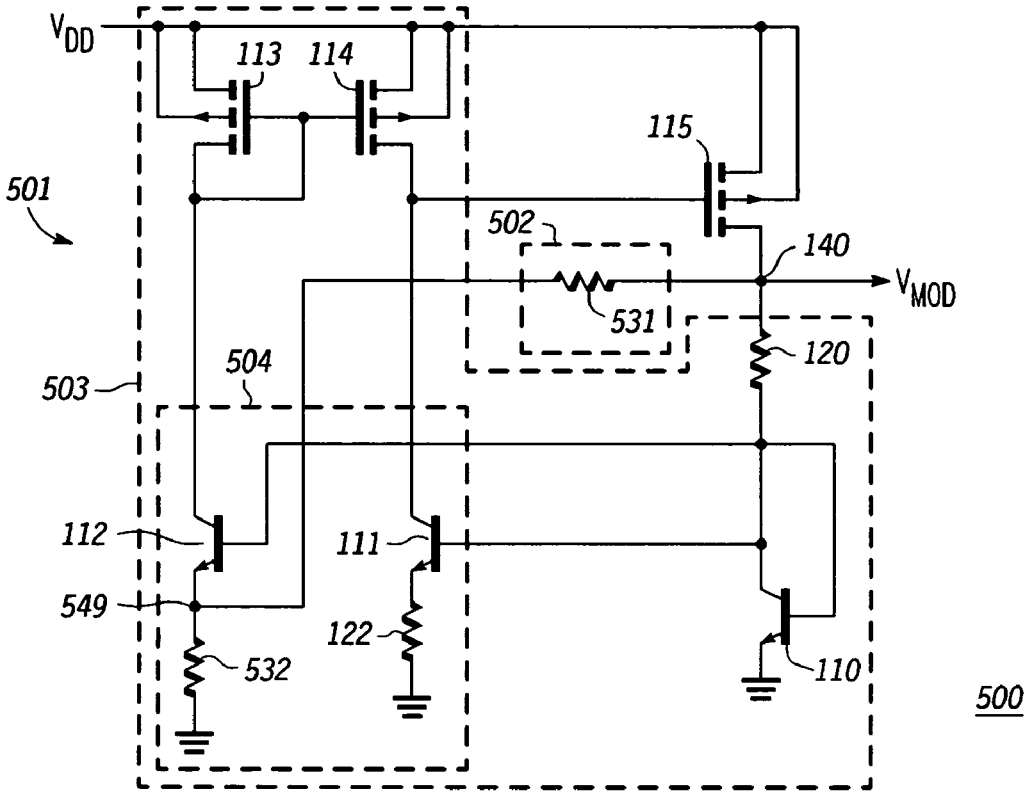
FIG. 5 illustrates a fourth reference circuit according to a fourth embodiment of the present invention.

FIG. 5 illustrates a reference circuit 500 of a fourth embodiment of the present invention. In this embodiment, circuit 500 can output a voltage larger than 1.25 V when circuit 500 is built on a silicon substrate.

As an example, reference circuit 500 in FIG. 5 can comprise a Widlar bandgap circuit 501 and a modification circuit 502 coupled to circuit 101. As an example, circuit 501 can be similar to circuit 101 in FIG. 1, plus a resistor 532. A bandgap core circuit 503 can be similar to circuit 103 in FIG. 1, plus resistor 532. A $\Delta V_{BE}$ loop 504 can be similar to loop 104 in FIG. 1 plus resistor 532. In one embodiment, circuit 502 can comprise a resistor 531 electrically coupled to the output at node 140 and to $\Delta V_{BE}$ loop 504 at a node 549. Transistor 112 and node 549 are coupled to ground through resistor 532. Coupling circuit 502 between nodes 140 and 549 adds a second current to the current in transistor 112 to modify the output voltage at node 140 of circuit 500. When circuit 502 is present in circuit 500, the current in transistor 112, $I_{112}$, is:

$$I_{112} = \frac{\Delta V_{BE}}{R_{122}} + \frac{V_{mod}}{R_{531}}$$

where $V_{mod}$ is the modified or new output voltage at node 140, $\Delta V_{BE}$ is the voltage drop across resistor 122, $R_{122}$ is the resistance of resistor 122, and $R_{531}$ is the resistance of resistor 531. Specifically, the new reference voltage, $V_{mod}$, is equal to:

$$\begin{aligned} V_{mod} &= V_{BE} + I_{112} \cdot R_{120} \\ &= V_{BE} + \left(\frac{\Delta V_{BE}}{R_{122}} + \frac{V_{mod}}{R_{531}}\right) \cdot R_{120} \\ &\cong \frac{V_{Bandgap}}{1 - \frac{R_{120}}{R_{531}}} \end{aligned}$$

where $V_{Bandgap}$ is same as explained previously with respect to circuit 100 in FIG. 1.

Thus, by choosing suitable ratio of the resistance values of resistor 120 and 531, an arbitrary reference voltage larger than the bandgap voltage of silicon can be created at the output of circuit 500 when circuit 500 is built on a silicon substrate. As in previous embodiments, the output voltage of circuit 500 is substantially independent of temperature and the input voltage to circuit 501.

Figure 6:
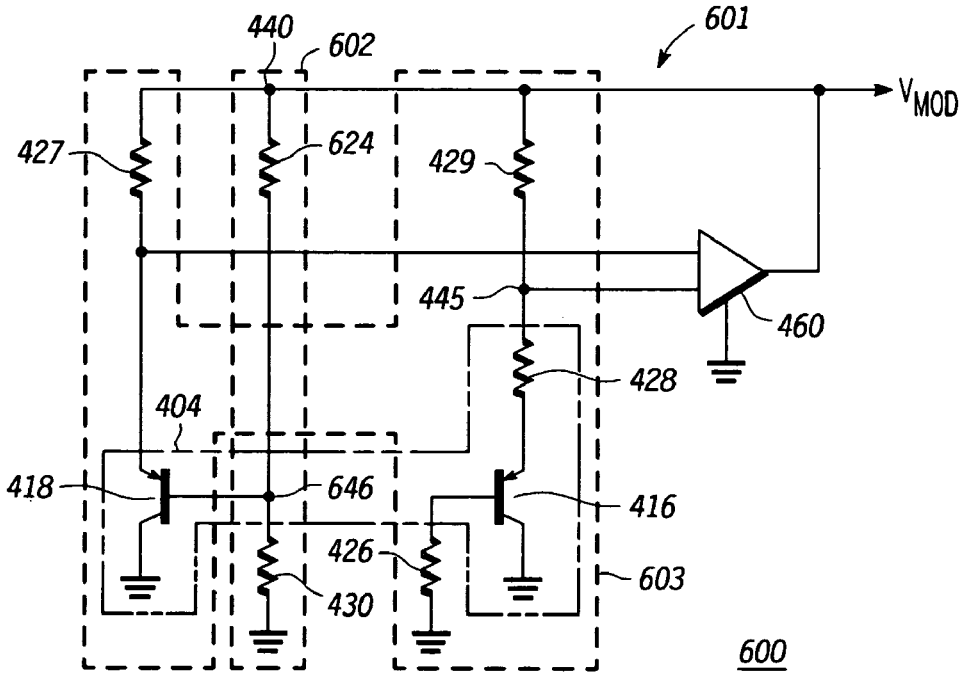
FIG. 6 illustrates a fifth reference circuit according to a fifth embodiment of the present invention.

FIG. 6 illustrates a voltage referent circuit 600 according to a fifth embodiment of the present invention. In this embodiment, circuit 600 can output a voltage larger than 1.25 V when circuit 600 is built on a silicon substrate.

As an example, circuit 600 in FIG. 6 can comprise a bandgap circuit 601 and a modification circuit 602 coupled to circuit 601. Circuit 603 comprises transistors 416 and 418, and resistors 426, 427, 428, and 429. A $\Delta V_{BE}$ loop 604 of circuit 403 comprises transistors 416 and 418 and resistor 428.

In this embodiment, circuit 602 comprises resistors 624 and 630. Resistor 624 is electrically coupled to nodes 440 and 646. Coupling circuit 602 between nodes 440 and 646 adds a second substantially fixed current to the current in transistor 418 to modify the output voltage of bandgap core circuit 603. Similar to the fourth embodiment in FIG. 5, the new or modified output reference voltage at node 640, Vmod, is:

$$V_{mod} \cong \frac{V_{BG}}{1 - \frac{R_{428}}{R_{624}}}$$

where $V_{BG}$ is output voltage at node 440 of circuit 600 without circuit 602 present, $R_{428}$ is the resistance of resistor 428, and $R_{624}$ is the resistance of resistor 624.

In a further embodiment of the invention, circuits 400 and 600 of FIG. 4 and can be combined to make a circuit whose output is continuously adjustable from a value less than a bandgap voltage to a value greater than a bandgap voltage.

Figure 7:
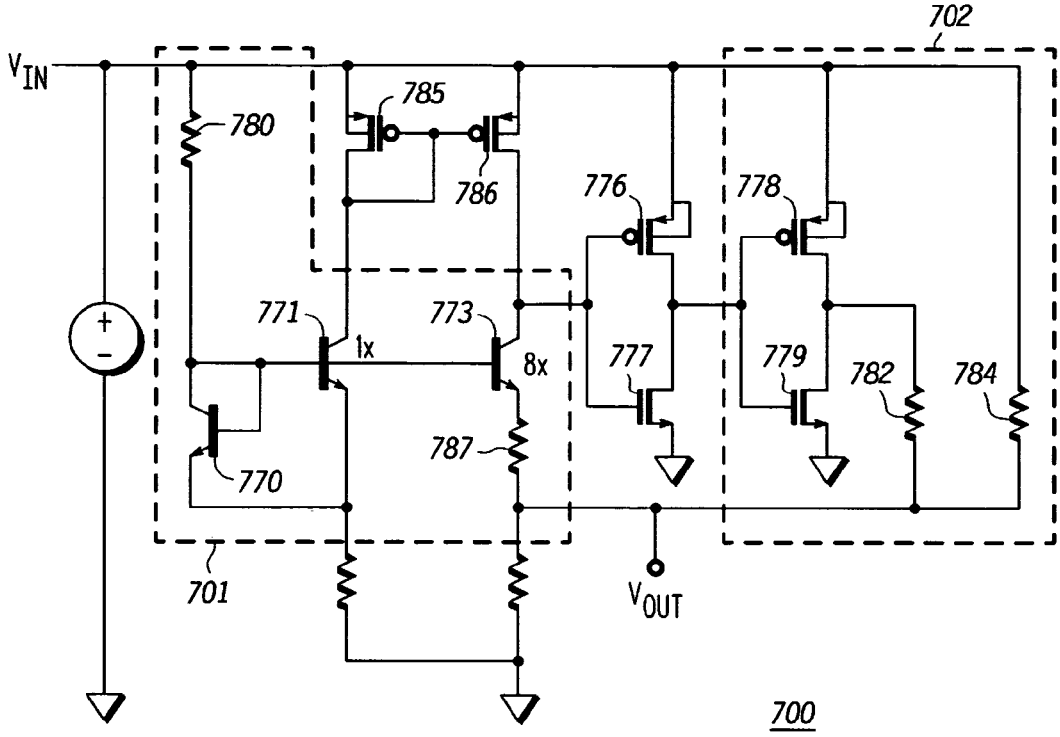
FIG. 7 illustrates a Power on Reset (POR) circuit, which uses a reference circuit in accordance with another embodiment of the present invention.
Figure 8:
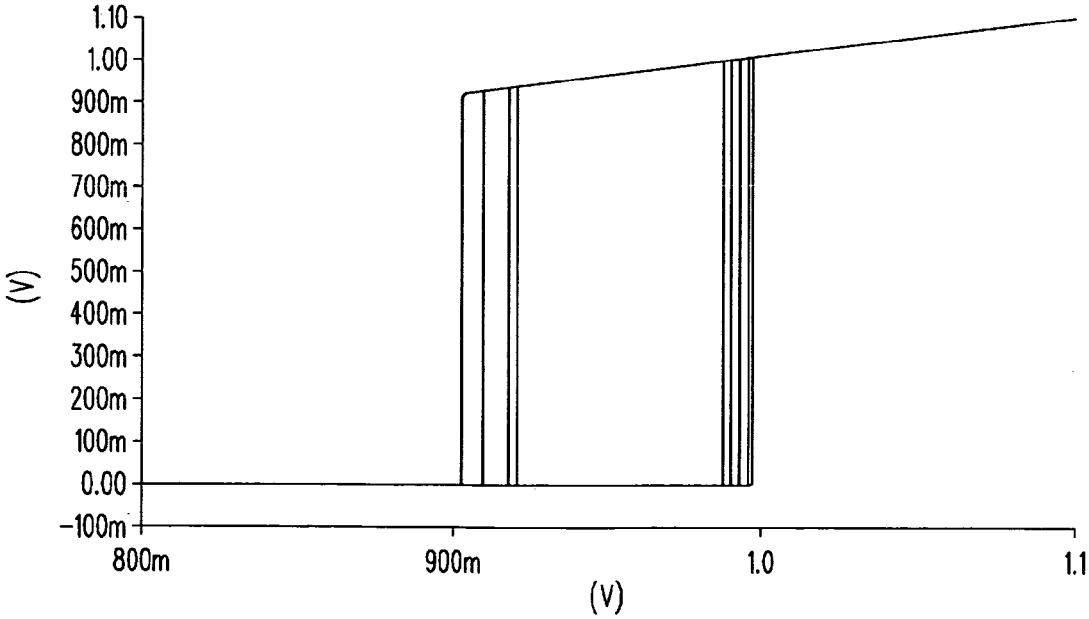
FIG. 8 is a graph showing the relationship between input voltage and output voltage of the circuit of FIG. 7.

FIG. 7 illustrates power or reset (POR) circuit 700, which uses a reference circuit in accordance with another embodiment of the present invention. FIG. 8 is a graph showing the relationship between input voltage and output voltage of circuit 700 in FIG. 7. In FIG. 8, the x-axis is voltage, and the y-axis is the output voltage of circuit 700 in FIG. 7.

In circuit 700 of FIG. 7, a bandgap core circuit 701 includes transistors 770, 771, and 773 and resistor 780. A modification circuit 702 includes transistors 778 and 779 and resistors 784 and 782. When transistor 778 is on and transistor 779 is off, resistors 782 and 784 operate in parallel, and thus, $V_{out}$ will be smaller than when current is solely running through resistor 784. Transistors 776 and 778 form a CMOS (complementary metal oxide semiconductor) inverter circuit, and transistors 777 and 778 act to switch the resistor 782 between being coupled to the input voltage and ground. In another embodiment of circuit 700, transistor 776, 777, 778, and 779 can be inverters instead of transistors.

When an input voltage, $V_{in}$, is very low, transistor 773 will have approximately eight times the current compared to transistor 771, because of the configuration of transistors 785 and 786. However, as input voltage, $V_{in}$, increases, the current in transistor 773 will not increase as fast as the current in transistor 771 because of a series resistor 787. Instead, a significant voltage drop develops across resistor 787, which limits the current in transistor 773.

Furthermore, while input voltage, $V_{in}$, is low, the gates of transistors 776, 779, and 778 are low. Thus, transistor 778 is off, and transistor 779 is on. When transistor 779 is on and transistor 778 is off, resistor 782 is coupled to ground.

When the input voltage reaches approximately 1 V in this example, the current in transistors 771 and 773 are approximately equal. At this point, the voltage at the gates of transistors 776, 778, and 779 goes high. Thus, transistor 779 is turned off, and transistor 778 is turned on. When transistor 779 is off and transistor 778 is on, resistor 782 is in parallel with resistor 784. This configuration changes the threshold voltage of circuit 700 from approximately 1 V to approximately 0.9 V. Therefore, the circuit 700 will toggle off when input voltage, $V_{in}$, falls below 0.9 V, and the hysteresis curve shown in FIG. 8 is created.

Figure 9:
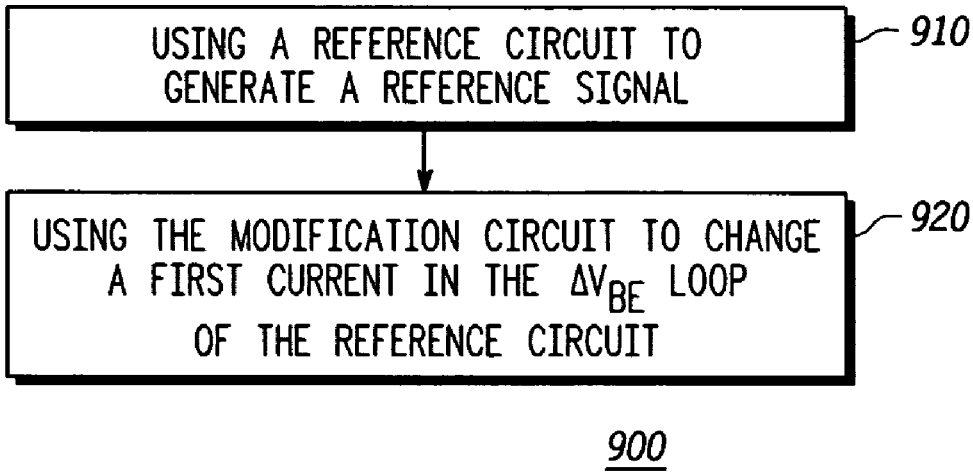
FIG. 9 is a flow-chart of a method of generating an output voltage from a reference circuit.

FIG. 9 is a flow-chart of a method of generating a reference signal from a reference circuit. Flow chart 900 includes a step 910 of using a reference circuit to generate an output voltage. For example, the reference circuit can be a bandgap core circuit and include a $\Delta V_{BE}$ loop.

Flow chart 900 in FIG. 9 continues with a step 920 of using the modification circuit to change a first current in a $\Delta V_{BE}$ loop. As an example, the modification circuit can be electrically coupled to the output voltage and the $\Delta V_{BE}$ loop of a bandgap core circuit. This modification circuit uses the output voltage of the bandgap core circuit to change a current in the $\Delta V_{BE}$ loop. In one embodiment, the modification circuit changes the current of the $\Delta V_{BE}$ loop by subtracting or adding a current to the $\Delta V_{BE}$ loop with a current generated from the output voltage. The modified or new output voltage can be larger or small than 1.25 V, even when the circuit is formed in silicon.

Figure 10:
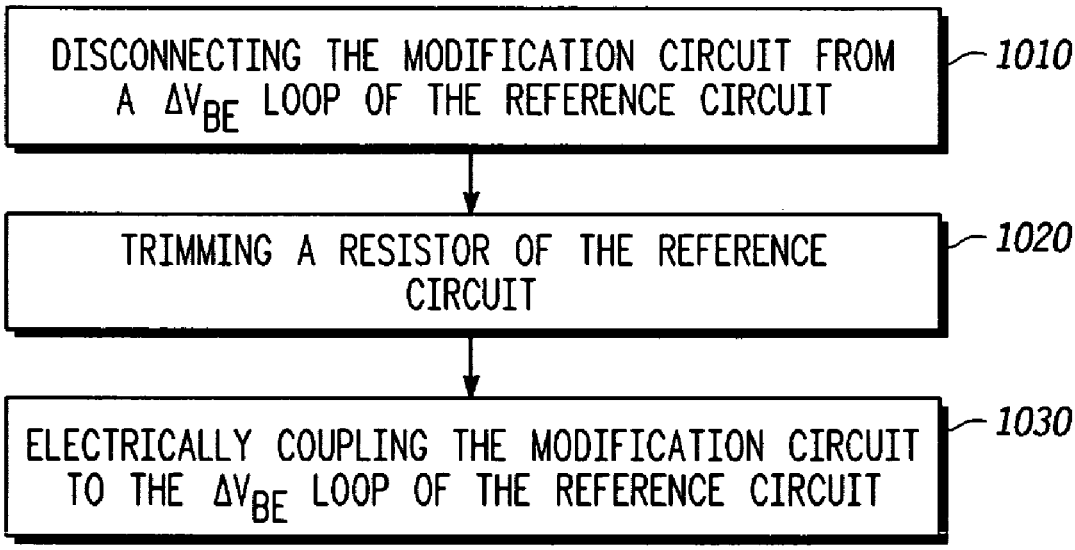
FIG. 10 is a flow-chart of a method of trimming a resistor in a reference circuit.

Additionally, resistors in a bandgap core circuit can be trimmed to improve operation of the circuit. Trimming resistors in the bandgap core circuit can substantially eliminate temperature dependence of the output voltage caused by resistor mismatch and other error sources. FIG. 10 is a flowchart of a method of trimming a resistor in a reference circuit. The steps in this method are preferably performed before step 910 in method 900 of FIG. 9. However, the steps in the method of flow chart 1000 in FIG. 10 can be performed subsequent to any step in the method of FIG. 9.

Flow chart 1000 in FIG. 10 includes a step 1010 of disconnecting the modification circuit from the $\Delta V_{BE}$ loop of the bandgap core circuit. As an example, the modification circuit can be disconnected by opening a switch coupled in series with the modification circuit, as shown in the embodiment of FIG. 3. This step can be omitted if a modification circuit has not yet been coupled to the $\Delta V_{BE}$ loop of the bandgap core circuit.

Flow chart 1000 in FIG. 10 continues with a step 1020 for trimming a resistor of the bandgap core circuit. Trimming the resistor causes the unmodified bandgap core circuit to produce a reference voltage equal to bandgap voltage. The methodology of trimming of a resistor in a bandgap circuit is well-know in the art and will not be described herewithin.

Subsequently, flow chart 1000 in FIG. 10 continues with a step 1030 for electrically coupling the modification circuit to the $\Delta V_{BE}$ loop. As an example, the modification circuit can be coupled to the bandgap circuit by closing a switch coupled in series with the modification circuit, as shown in the embodiment of FIG. 3.

Figure 11:
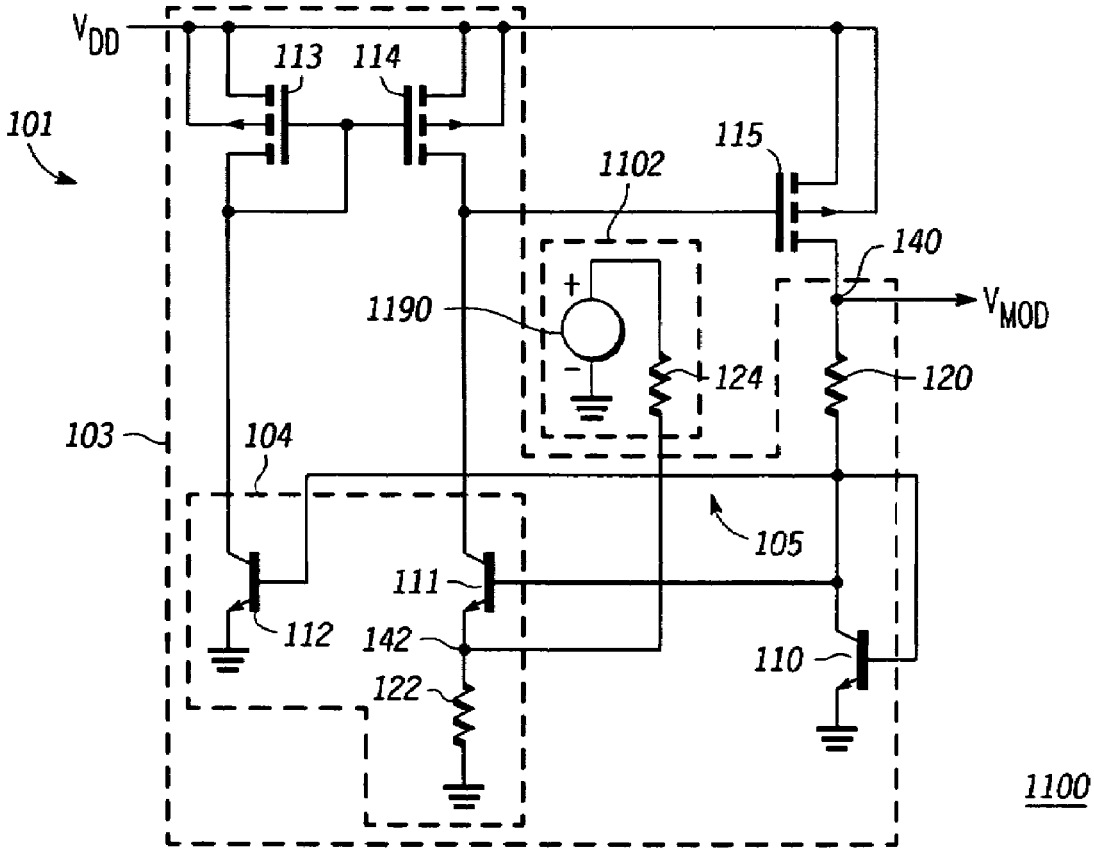
FIG. 11 illustrates a sixth reference circuit according to a sixth embodiment of the present invention.

FIG. 11 illustrates a reference circuit 1100 of a sixth embodiment of the present invention. In this embodiment, a modification circuit 1102 uses a new voltage source 1190 to change a first current in the $\Delta V_{BE}$ loop.

As an example, circuit 1100 can be similar for circuit 100 of FIG. 1, except that modification circuit 1102 also includes a voltage source 1190 and is not coupled to node 140. Source 1190 is coupled to resistor 124. Instead of using $V_{Bandgap}$ to change in a current in loop 104, circuit 1102 uses the voltage generated by source 1190 to change the current in transistor 111.

When the output voltage, $V_{mod}$, was calculated for the reference circuit of the present invention, $V_{BE}$ in the reference circuit with a modification circuit was assumed to be equal to the $V_{BE}$ of the conventional reference circuit. However, as previously noted, there is a small error because the $V_{BE}$ used in an embodiment of the present invention is not identical to the $V_{BE}$ of the reference circuit without the modification circuit.

To calculate the error, $V'_{BE}$ of transistor in a reference circuit with the modification circuit present, can be more accurately approximated by the $V_{BE}$ of a transistor in the conventional reference circuit minus a component equal to the small signal resistance of the transistor times the current change caused by the introduction of the modification circuit. Thus, when the modification circuit is electrically coupled to the bandgap core circuit, $V'_{BE}$ is $$V'_{BE} = V_{BE} + \delta I \cdot \frac{V_T}{I}$$

-continued where $\frac{V_T}{I}$ is the small signal resistance added to bandgap core circuit by the coupling of the modification circuit, and $\delta I$ is the corresponding current change. Assuming, $$I \approx \frac{\Delta V_{BE}}{R_1}$$

$$\Delta V_{BE} = V_T \cdot \ln(N)$$

$$\delta I = -\frac{\alpha \cdot V_{mod}}{R_1}$$

where $R_1$ is the resistance of a resistor $R_1$ in the bandgap core circuit, $\Delta V_{BE}$ is the voltage drop across resistor $R_1$ in the bandgap core circuit, a is a constant equal to $$\frac{R_1}{R_3},$$

$R_3$ is the resistance of a resistor in the modification circuit, N is the difference between the base emitter voltages of the two transistors operating at different current densities in the reference circuit, and $V_T$=KT/q, where K is Boltmann's constant, T is the absolute temperature, and q is the electronic charge constant. Thus, the modified output voltage, $V_{mod}$ can be calculated to be:

$$\begin{aligned} V'_{BE} &= V_{BE} - \frac{\alpha \cdot V_{mod}}{R_1} \cdot \frac{V_T}{\Delta V_{BE}} \cdot R_1 \\ &= V_{BE} - \frac{\alpha \cdot V_{mod} \cdot V_T}{\Delta V_{BE}} \end{aligned}$$

$$\begin{aligned} V_{mod} &= V'_{BE} + (\Delta V_{BE} - \alpha \cdot V_{mod}) \cdot \frac{R_2}{R_1} \\ &= V'_{BE} + \Delta V_{BE} \cdot \frac{R_2}{R_1} - \alpha \cdot V_{mod} \cdot \frac{R_2}{R_1} \\ &= V_{BE} + \frac{\alpha \cdot V_{mod} \cdot V_T}{\Delta V_{BE}} + \Delta V_{BE} \cdot \frac{R_2}{R_1} - \alpha \cdot V_{mod} \cdot \frac{R_2}{R_1} \\ &= V_{Bandgap} - \alpha \cdot V_{mod} \cdot \left(\frac{R_2}{R_1} + \frac{V_T}{\Delta V_{BE}}\right) \\ &= V_{Bandgap} - \alpha \cdot V_{mod} \cdot \left(\frac{R_2}{R_1} + \frac{1}{\ln(N)}\right) \end{aligned}$$

$$V_{mod}\left(1 + \alpha \cdot \left(\frac{R_2}{R_1} + \frac{1}{\ln(N)}\right)\right) = V_{Bandgap}$$

$$V_{mod} = \frac{V_{Bandgap}}{\left(1 + \alpha \cdot \left(\frac{R_2}{R_1} + \frac{1}{\ln(N)}\right)\right)}$$

The term $$\frac{1}{\ln(N)}$$

is small compared to $$\frac{R_2}{R_1}.$$

As an example, in one implementation of circuit 100 of FIG. 1, N is 8, and the resistance of $R_1=R_{124}=55{,}000$ ohms and the resistance of $R_2=R_{120}=200{,}000$ ohms. In this example, $$\frac{R_1}{R_2} = 10.5 \text{ and } \frac{1}{\ln(N)} = 0.5$$

so the overall change is quite small. Thus, the small term $$\frac{1}{\ln(N)}$$

can generally be ignored and $V_{mod}$, as explained previously is:

$$V_{mod} \cong \frac{V_{Bandgap}}{\left(1+\alpha\cdot\frac{R_2}{R_1}\right)} \cong \frac{V_{Bandgap}}{\left(1+\frac{R_2}{R_3}\right)}$$

This equation is accurate for small changes to the reference voltage, but because the baseline current changes also, there is a small 2nd order change that is not taken into consideration. In any case, the temperature coefficient is still zero. Additional changes can be made where the output voltage is a multiple of bandgap voltage and the modification circuit can be used to adjust this value.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the bandgap circuit may be implemented in a variety of circuit designs, and that the foregoing discussion of certain of these embodiments does not necessarily represent a complete description of all possible embodiments. As another example, the modified output voltage, $V_{mod}$, of an embodiment can be other factors, other than being inversely proportional to $(1+R_2/R_3)$. As further example, a disconnection circuit similar to disconnection circuit 305 in FIG. 3 can be added to any of the embodiments described herein.

Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims. Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A reference circuit comprising:

a first reference circuit having a first node for providing a reference signal and a $\Delta V_{BE}$ loop; and a modification circuit using a first voltage to change a first current in the $\Delta V_{BE}$ loop of the first reference circuit, where:

the change in the first current in the $\Delta V_{BE}$ loop of the first reference circuit changes the reference signal to a modified reference signal;

$$V_{mod} \cong \frac{V_{Bandgap}}{\left(1+\frac{R_2}{R_3}\right)}$$

where $V_{mod}$ modified reference signal, $V_{Bandgap}$ is the reference signal of the first reference circuit without the modification circuit present, $R_2$ is a resistance value of a resistor in the first reference circuit, and $R_3$ is a resistance value of a resistor in the modification circuit; and the modification circuit is electrically coupled in a path between the first node and the $\Delta V_{BE}$ loop of the first reference circuit.

2. The reference circuit of claim 1, wherein:

the modification circuit subtracts a second current from the first current in the $\Delta V_{BE}$ loop of the first reference circuit to modify the reference signal of the first reference circuit.

3. The reference circuit of claim 2, wherein:

the second current is a substantially fixed current, derived from the first voltage.

4. The reference circuit of claim 1, wherein:

the modification circuit adds a second current to the first current in the $\Delta V_{BE}$ loop of the first reference circuit to modify the reference signal of the first reference circuit.

5. The reference circuit of claim 4, wherein:

the second current is a substantially fixed current, derived from the first voltage.

6. The reference circuit of claim 1, wherein:

the modification circuit comprises a resistor electrically coupled between the first node and the $\Delta V_{BE}$ loop of the first reference circuit.

7. The reference circuit of claim 6, further comprising:

a switch to permit electrical disconnection of the resistor from $\Delta V_{BE}$ loop of the first reference circuit.

8. The reference circuit of claim 1, further comprising:

a disconnection circuit electrically coupled to the first reference circuit to permit electrical disconnection of the modification circuit front the $\Delta V_{BE}$ loop of first reference circuit.

9. The reference circuit of claim 1, wherein:

the modification circuit subtracts a substantially fixed second voltage from a first voltage in the $\Delta V_{BE}$ loop of the first reference circuit to change the first current in the $\Delta V_{BE}$ loop of the first reference circuit.

10. The reference circuit of claim 1, wherein:

the modified reference signal is substantially independent of temperature and an input voltage to the first reference circuit.

11. The reference circuit of claim 1, wherein the modified reference signal is lower than a voltage of a bandgap voltage of silicon.

12. The reference circuit of claim 1, wherein the first reference circuit is a portion of Widlar bandgap circuit.

13. The reference circuit of claim 1, wherein:

the reference circuit is characterized as a voltage reference circuit.

14. The reference circuit of claim 1, wherein:

the reference circuit is characterized as a current reference circuit.

15. The reference circuit of claim 1, wherein:

the first reference circuit comprises a bandgap core circuit.

16. A circuit for generating a reference voltage comprising:

a bandgap core circuit having an output voltage and a $\Delta V_{BE}$ loop;

a modification circuit using the output voltage of the bandgap core circuit to change a first current in the $\Delta V_{BE}$ loop of the bandgap core circuit and to change the output voltage to a modified output voltage, wherein:

$$V_{mod} \cong \frac{V_{Bandgap}}{\left(1 + \frac{R_2}{R_3}\right)}$$

where $V_{mod}$ is tie modified output voltage, $V_{Bandgap}$ is the output voltage of the bandgap core circuit without the modification circuit present, $R_2$ is a resistance value of a resistor in the bandgap core circuit and $R_3$ is a resistance value of a resistor in the modification circuit.

17. The reference circuit of claim 16, wherein:

the modification circuit subtracts a second current from the first current in the $\Delta V_{BE}$ loop of the bandgap core circuit to modify the output voltage of the bandgap core circuit.

18. The reference circuit of claim 17, wherein:

the second current is a substantially fixed current, derived from the output voltage.

19. The reference circuit of claim 16, wherein:

the modification circuit adds a second current to the first current in the $\Delta V_{BE}$ loop of the bandgap core circuit to modify the output voltage of the bandgap core circuit.

20. The reference circuit of claim 19, wherein:

the second current is a substantially fixed current, derived from the output voltage.

21. The reference circuit of claim 16, wherein:

the modification circuit comprises a resistor electrically coupled between a first node of the bandgap core circuit and the $\Delta V_{BE}$ loop of the bandgap core circuit.

22. The reference circuit of claim 21, further comprising:

a switch to permit electrical disconnection of the resistor from $\Delta V_{BE}$ loop of the bandgap core circuit.

23. The reference circuit of claim 16, further comprising:

a disconnection circuit electrically coupled to the bandgap core circuit to permit electrical disconnection of the modification circuit from the $\Delta V_{BE}$ loop of the bandgap core circuit.

24. The reference circuit of claim 16, wherein:

the modified output voltage is substantially independent of temperature and an input voltage to the bandgap core circuit.

25. The reference circuit of claim 16, wherein the modified output voltage is lower than a voltage of a bandgap voltage of silicon.

* * * * *